US006848926B2

(12) United States Patent
Ling et al.

(10) Patent No.: US 6,848,926 B2
(45) Date of Patent: Feb. 1, 2005

(54) SECURING DEVICE HAVING BYPASS INTERFACE

(75) Inventors: Renny Tse-Haw Ling, Chungho (TW); Chang-Chiang Yu, Chungho (TW)

(73) Assignee: Sinox Company Ltd., Chungho (TW)

( * ) Notice: Subject to any disclaimer, the term of this patent is extended or adjusted under 35 U.S.C. 154(b) by 0 days.

(21) Appl. No.: 10/413,734

(22) Filed: Apr. 15, 2003

(65) Prior Publication Data

US 2004/0180566 A1 Sep. 16, 2004

(51) Int. Cl.[7] ..... H01R 13/62
(52) U.S. Cl. ..... 439/304; 70/58; 439/502
(58) Field of Search ..... 439/304, 502; 70/57, 58, DIG. 57

(56) References Cited

U.S. PATENT DOCUMENTS 4,669,281 A * 6/1987 Young ..... 70/57
5,190,465 A * 3/1993 Davidge et al. ..... 439/304
6,196,857 B1 * 3/2001 Fong ..... 439/304
6,212,922 B1 4/2001 Miao
6,297,963 B1 * 10/2001 Fogle ..... 361/747

* cited by examiner

*Primary Examiner*—Neil Abrams
(74) *Attorney, Agent, or Firm*—SenniergPowers

(57) ABSTRACT

Disclosed is a securing device having a bypass interface, particularly one to be connected to a connector provided on an electronic device and having at least one to-be-engaged means at an outer side thereof. The securing device includes: a bypass, to be electrically connected to the connector and having a bypass interface; a fastener engaging the to-be-engaged means after the bypass is connected to the connector; a lock mechanism, detachably locked to the bypass for preventing separation of the fastener from the to-be-engaged means; and a connecting member, for securing the combined lock mechanism and bypass to a fixture, so as to prevent the electronic device from being stolen while providing a bypass interface at the same time.

31 Claims, 15 Drawing Sheets

SECURING DEVICE HAVING BYPASS INTERFACE

CROSS-REFERENCES TO RELATED APPLICATIONS

Not Applicable

STATEMENT REGARDING FEDERALLY SPONSORED RESEARCH OR DEVELOPMENT

DESCRIPTION

Not Applicable

1. Field of Invention

This invention is related to a securing device having a bypass interface, particularly one to be connected to a connector provided on an electronic device and having at least one to-be-engaged means at an outer side thereof.

2. Background of Invention

Due to the reduced sizes of electronic devices, users of notebook computers, laptop computers, or other compact electronic devices, frequently worry about possible theft of their electronic devices.

The current computer, either a desktop computer or a laptop computer 1, as shown in FIG. 1, has a plurality of connectors 10 thereon for connecting with various peripheral accessories.

It is disclosed in U.S. Pat. No. 6,212,922 a lock for locking electronic devices. However, the locker eradicates the original functions provided once the connector locks it. Hence, a device that is locked to a connector furnished by the computer, such as a Line Printer Terminal (LPT) port, a parallel port, or a serial port usually connected to a mouse, to prevent the computer from being stolen while providing a bypass interface at the same time, is needed.

SUMMARY OF INVENTION

It is thus a primary object of this invention is to provide a securing device having a bypass interface meeting the above need, the securing device being connected to a connector provided on an electronic device and having at least one to-be-engaged means at an outer side thereof.

The securing device comprises: a bypass, to be electrically connected to the connector and having a bypass interface; a fastener engaging the to-be-engaged means after the bypass is connected to the connector to prevent separation of the bypass from the connector; a lock mechanism, detachably locked to the bypass for preventing separation of the fastener from the to-be-engaged means; and a connecting member, for securing the combined lock mechanism and bypass to a fixture.

Based on such disclosures, the lock mechanism may control the connection between the bypass and the connector once the fastener is engaged to the to-be-engaged means. According to an embodiment of this invention, the lock mechanism may prevent separation of the fastener from the to-be-engaged means such that the fastener cannot be disengaged from the to-be-engaged means. As such, the electronic device having the connector is locked in place once the connecting member is securing device is secured to a fixture. Under such a locking condition, the connector connected to the bypass may still be connected to other peripheral accessories or transmission lines.

The structures and characteristics of this invention can be realized by referring to the appended drawings and explanations of the preferred embodiments.

BRIEF DESCRIPTIONS OF DRAWINGS

DETAILED DESCRIPTION OF INVENTION

Figure 1:
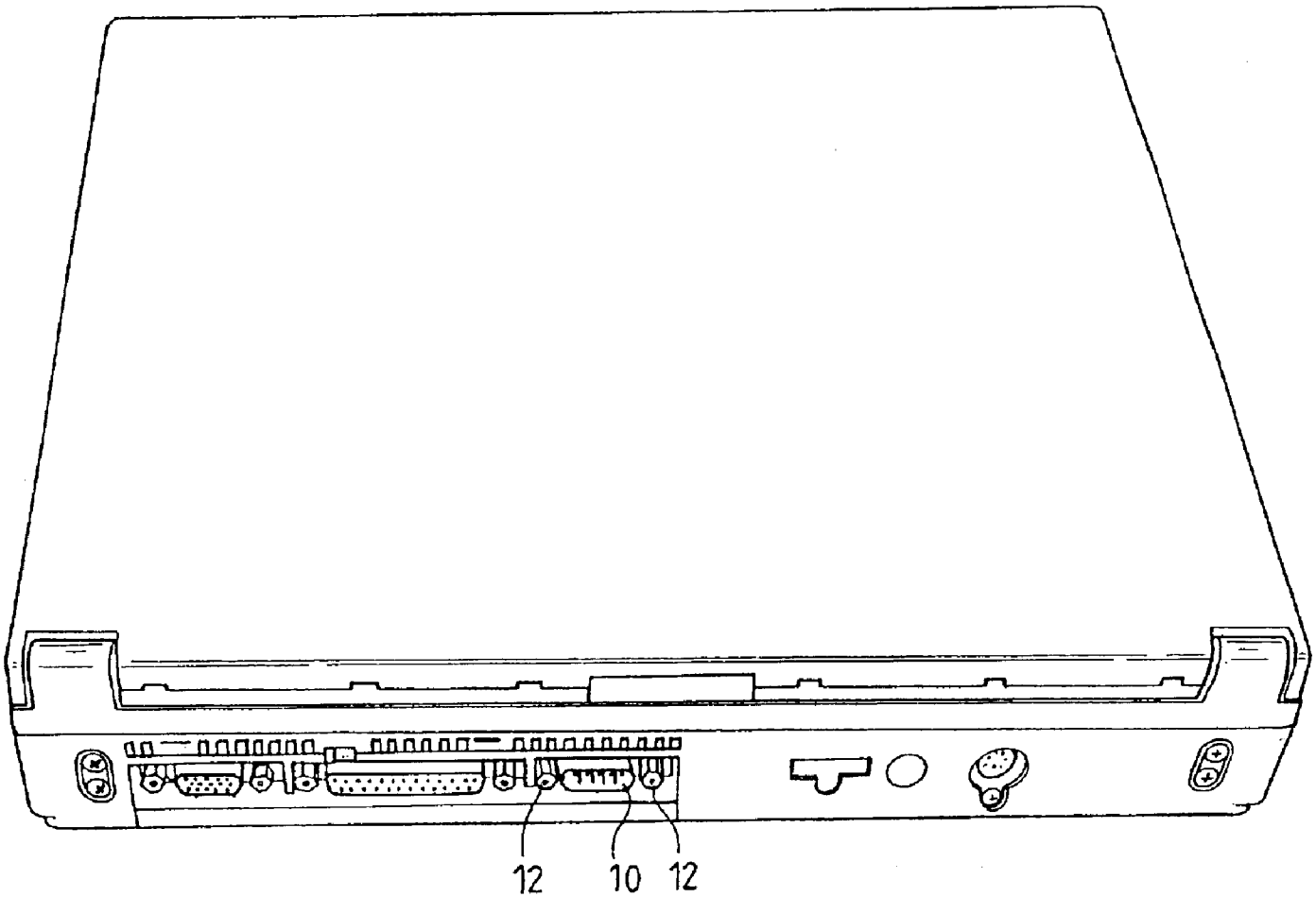
FIG. 1 is a schematic view showing the rear of a laptop computer.

This invention discloses a securing device 2 having a bypass interface, to be connected to a connector provided on an electronic device and having at least one to-be-engaged means 12 at an outer side thereof. The electronic device may include, but is not limited to, a desktop computer or a laptop computer 1 as show in FIG. 1.

Figure 2:
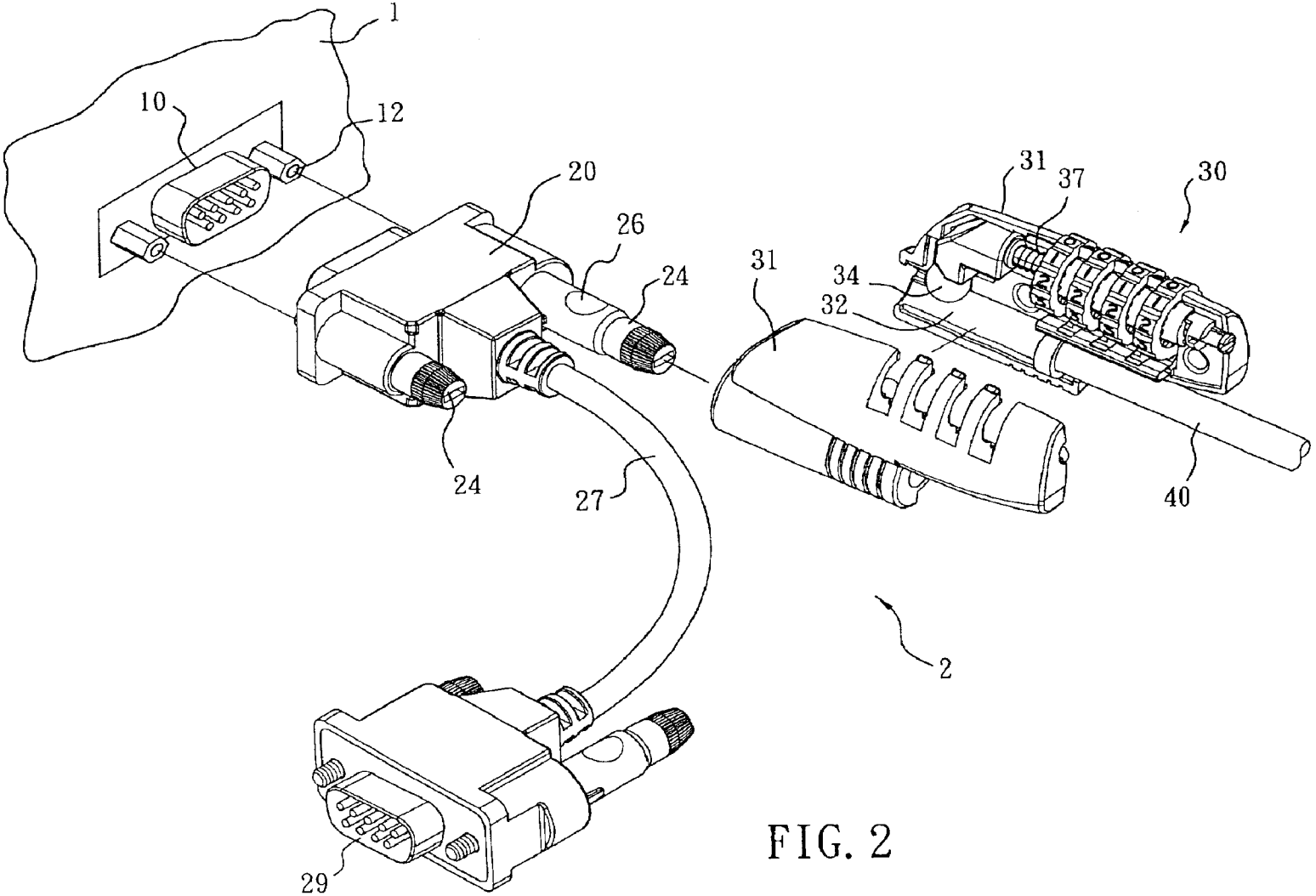
FIG. 2 is an exploded, perspective view showing a preferred embodiment according to this invention.
Figure 3:
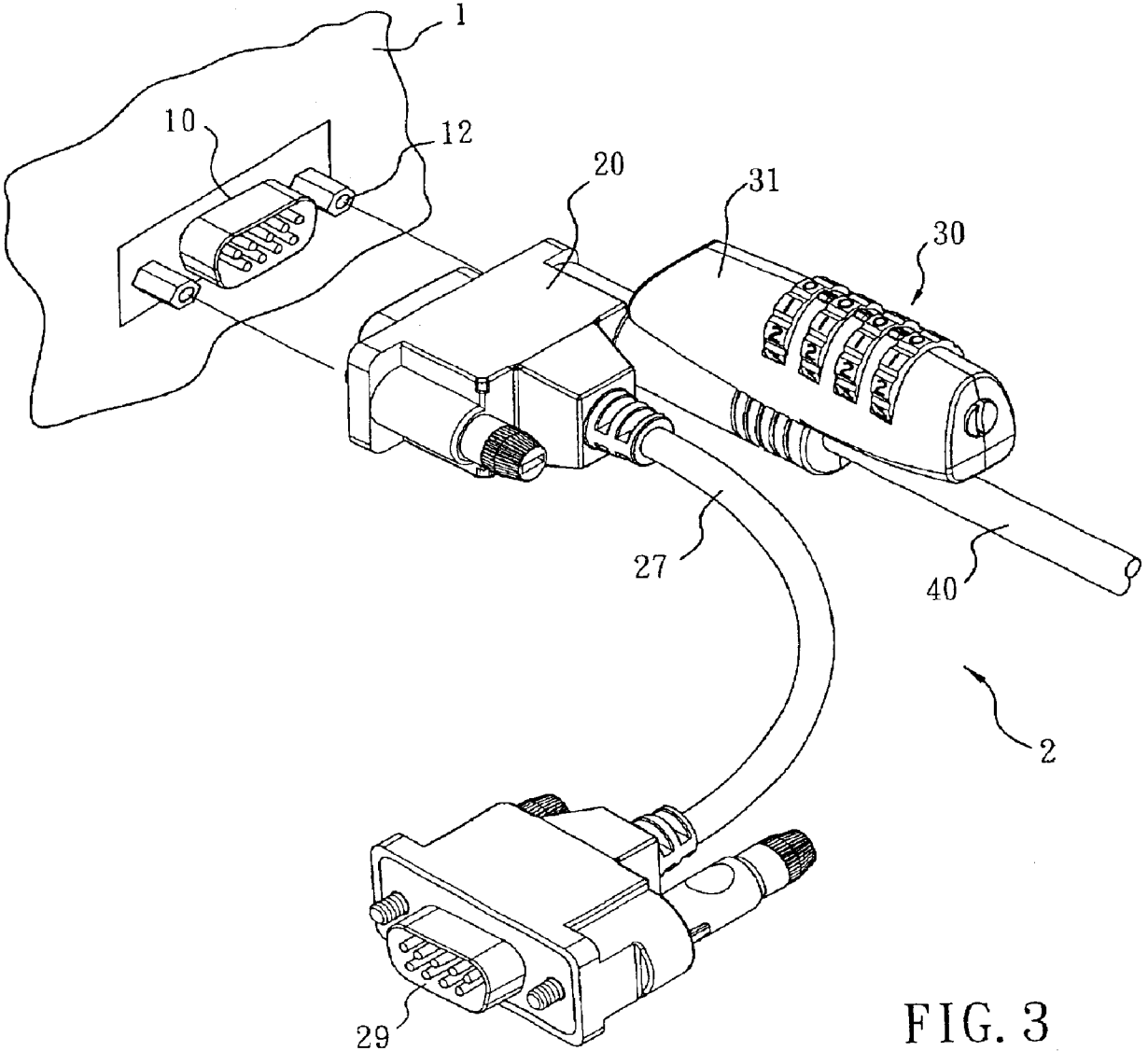
FIG. 3 is an assembled view showing the preferred embodiment of FIG. 2.

FIG. 2 is an exploded, perspective view showing a preferred embodiment according to this invention. FIG. 3 is an assembled view of the same embodiment. The securing device 2 includes: a bypass 20, to be electrically connected to the connector 10 provided on an electronic device 1 and having a bypass interface 29 that is electrically connected to the bypass 20 by means of a transmission line 27; at least a fastener 24 for engaging the to-be-engaged means 12 after the bypass 20 is connected to the connector 10; a lock mechanism 30, detachably locked to the bypass 20 for preventing separation of the fastener 24 from the to-be-engaged means 12; and a connecting member 40, for securing the combined lock mechanism 30 and bypass 20 to a fixture (see FIG. 9).

Preferably, the securing device 2 includes at least one fastener 24. The embodiment for the securing device 2 in FIG. 2 includes two fasteners 24 provided on the opposing sides of the bypass 20 thereof. The embodiment shown in FIGS. 2 and 3 is a securing device adapted to a conventional COM port. Hence, to accommodate the to-be-engaged means 12 of the conventional COM port, which generally includes two standard screw holes, the fasteners 24 are two bolts that may be threaded to the screw holes, and the bypass 29 preferably consists of interface specifications that are compatible to a COM port connector.

Figure 4:
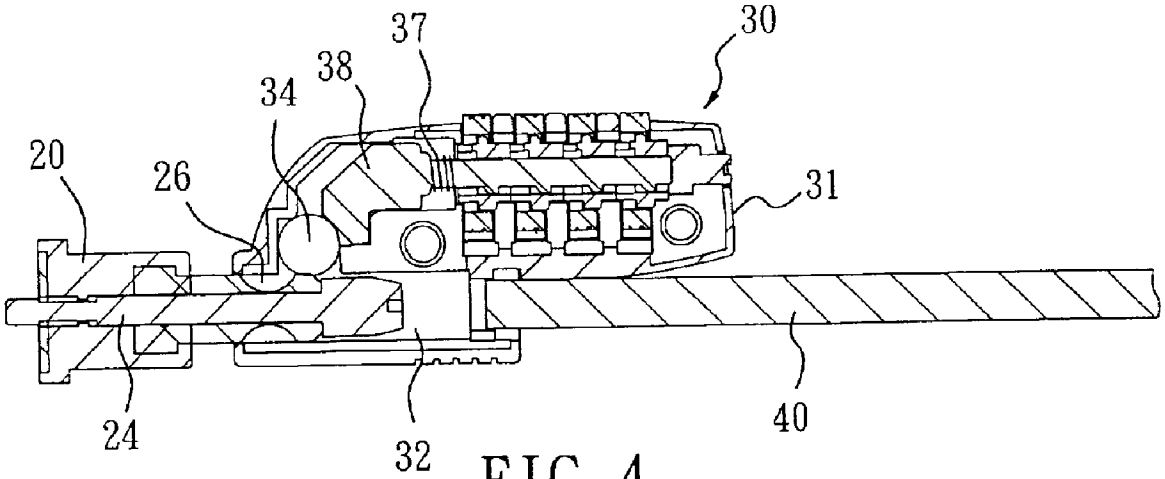
FIG. 4 is a cross-sectional view showing the embodiment of FIGS. 2 and 3 in which the lock mechanism is under the unlocked state.

With reference to FIG. 4, the lock mechanism 30 includes a housing 31 having an indent 32 for receiving and covering the fastener 24. Persons skilled in the art certainly may design the indent 32 according to the actual needs to cover part of the bypass 20. In fact, it is unnecessary for the housing 31 to cover the fastener 24 completely so long as the housing is capable of preventing separation of the fastener 24 from the to-be-engaged means 24.

According to this invention, the fastener 24 includes a recess 26 and the lock mechanism 30 includes a latch 34 to be inserted in the recess 26. In the current preferred embodiment, the latch 34 is a ball and the recess 26 is a semi-spherical corresponding recess. Of course, the latch 34 and the recess 26 can be provided to the lock mechanism 30 and the fastener 24, respectively, or adapt other appropriate shapes, but should not be constrained to those illustrated in the preferred embodiments. Furthermore, the recess 26 for mating with the latch 34 may be provided on the bypass 26 and the latch 34 is provided to allow mating with the recess 26. Such modifications are those that may be easily made by person skilled in the art.

The lock mechanism can be selected from, but is not limited to, any type of lock, such as the combination lock shown in FIGS. 2 to 5, an electronic lock, a key lock 35, drawing type lock 30', rotary 30" as shown in FIGS. 6, 10, 14 and 18, as long as the lock mechanism can be used to lock the housing 31 to the bypass 20. The detailed constructions of the combination lock, key lock, drawing type lock and rotary lock as shown in FIGS. 3–18 are known to persons in this field and thus are not described in details hereinafter.

Figure 5:
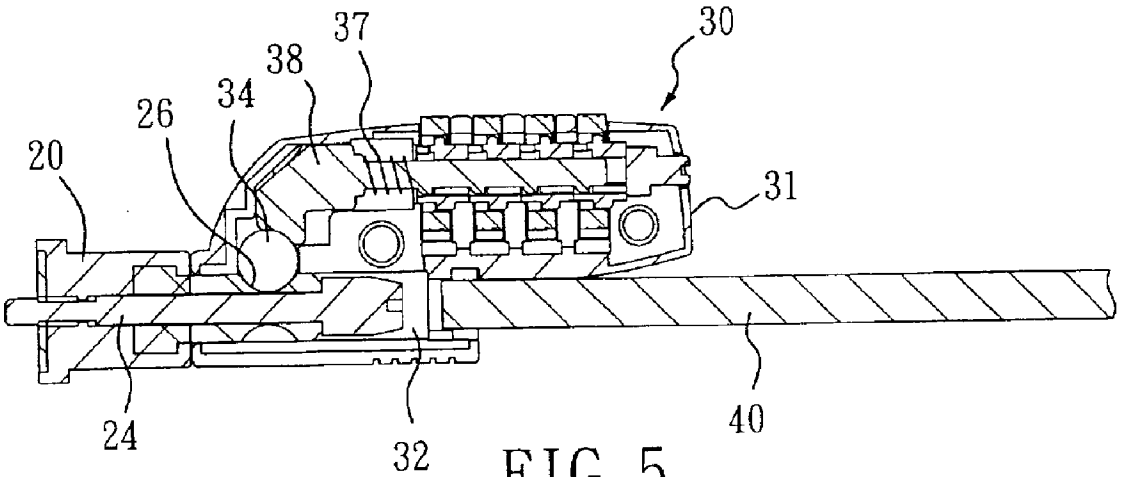
FIG. 5 is a cross-sectional view showing the embodiment of FIGS. 2 and 3 in which the lock mechanism is under the locked state.
Figure 6:
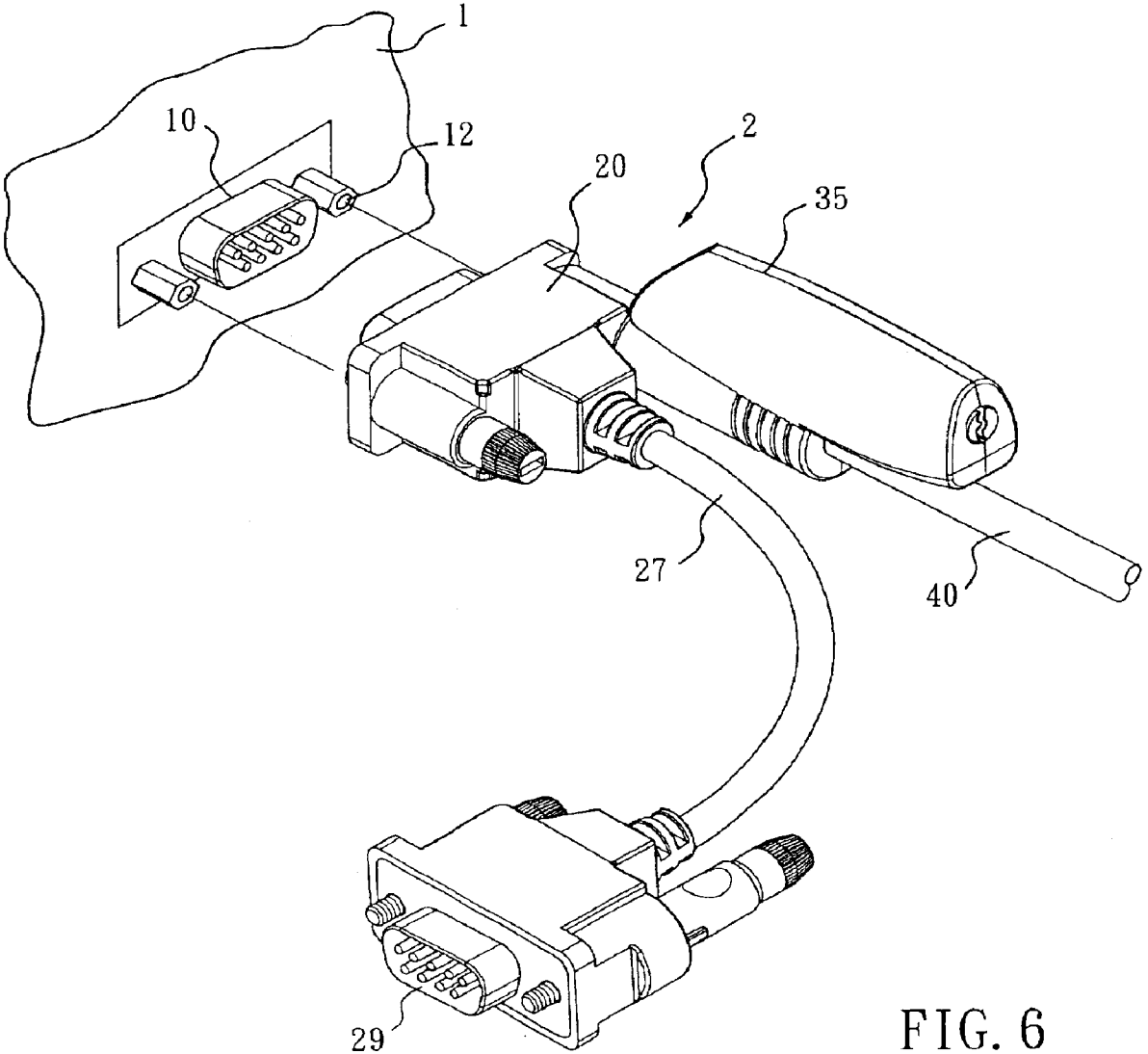
FIG. 6 is an exploded perspective view showing yet another preferred embodiment of this invention.

The locking relationships between the lock mechanism 30 and the fasteners 24 in this preferred embodiment may be referred to the cross-sectional views of FIGS. 4 and 5. In this embodiment, when the lock mechanism 30 is under an unlocked state, a controller 38 thereof is free from the influence of a spring 37 such that the controller 28 does not urge against or limit movement of the latch 34, as shown in FIG. 4. On the contrary, when the lock mechanism 30 is under the locked state, the latch 34 is wedged in the recess 26 such that the controller 38, as shown in FIG. 5, limits the vertical movement of the latch 34.

To use the embodiment shown in FIG. 2, the bypass 20 is first connected to the connector 10. The fasteners 24 are then threaded into the to-be-engaged means 12 of the connector 10. The indent 32 of the lock mechanism 30 then covers one of the fasteners 24 having the recess 26. After the lock mechanism 30 comes in place, the lock mechanism 30 is switched to the locked state as shown in FIG. 5, so as to lock the latch 34 in the recess 26 and to prevent the latch 34 from moving out of the recess 26, thereby locking the lock mechanism to the bypass 20. After the lock mechanism 30 is locked to the bypass 20, because the fastener 24 of the bypass 20 is covered by the housing 31, the lock mechanism 30 cannot be separated from the bypass 20 unless the lock mechanism 30 is switched to the unlocked state, thereby preventing access to the fastener 24 and preventing separation of the fastener 24 from the connector 10.

According to the disclosures of this invention, the connecting member 40 may be a cable, a steel cable, or chain connected to the bypass 20 or the lock mechanism 30, which can hardly be damaged. An end of the connecting member 40 may form a loop 42 at one end thereof to be wrapped to a fixture, such as a leg 70 of a table illustrated in FIG. 9, such that the computer 1 can be locked to the fixture 70 and cannot be removed. At the same time, the connector 10 can still be electrically accessed by way of the bypass 29 so as to retain the original function of the connector 10.

Figure 7:
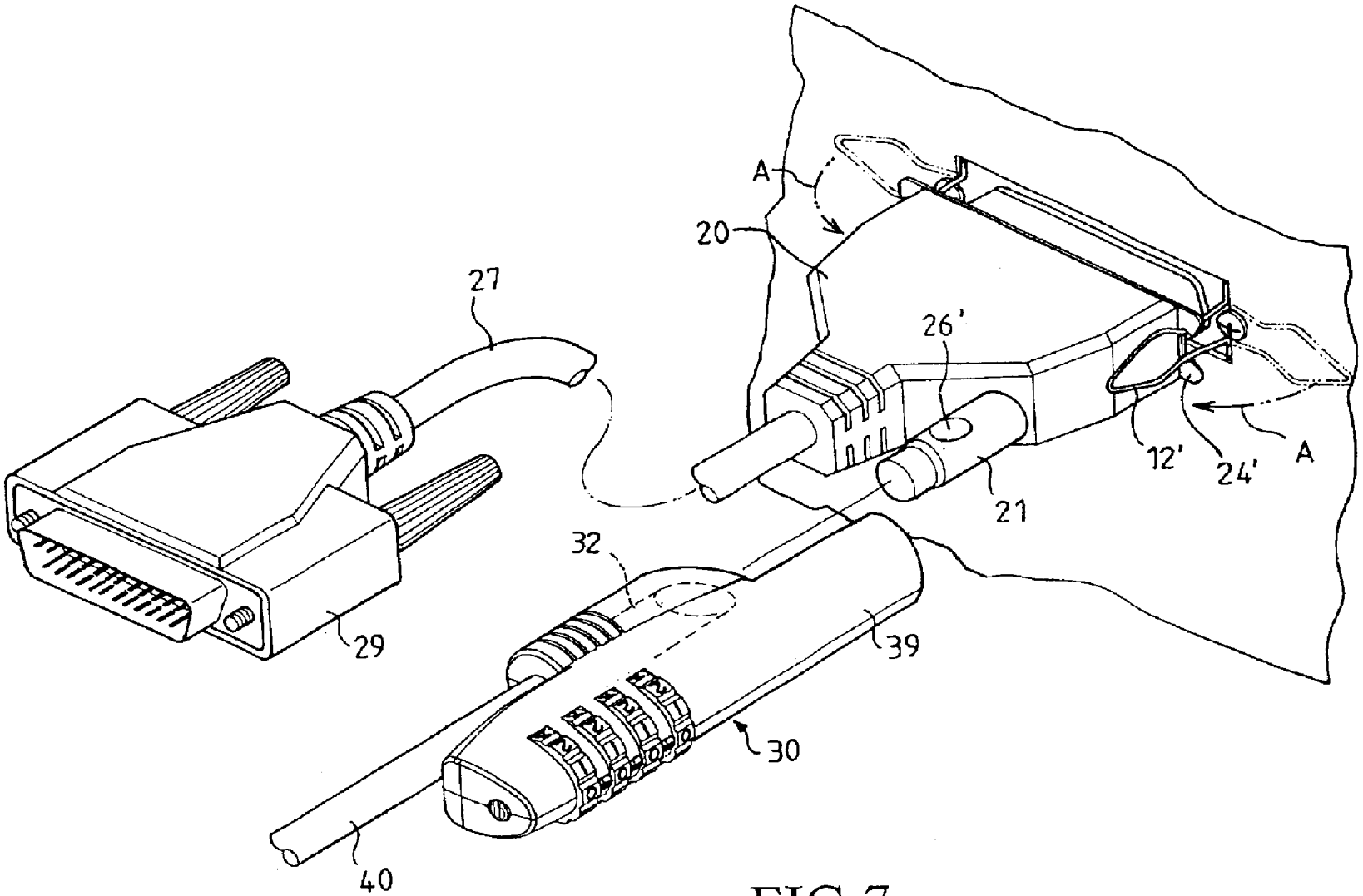
FIG. 7 is a perspective view showing this invention being applied to another connector type.
Figure 8:
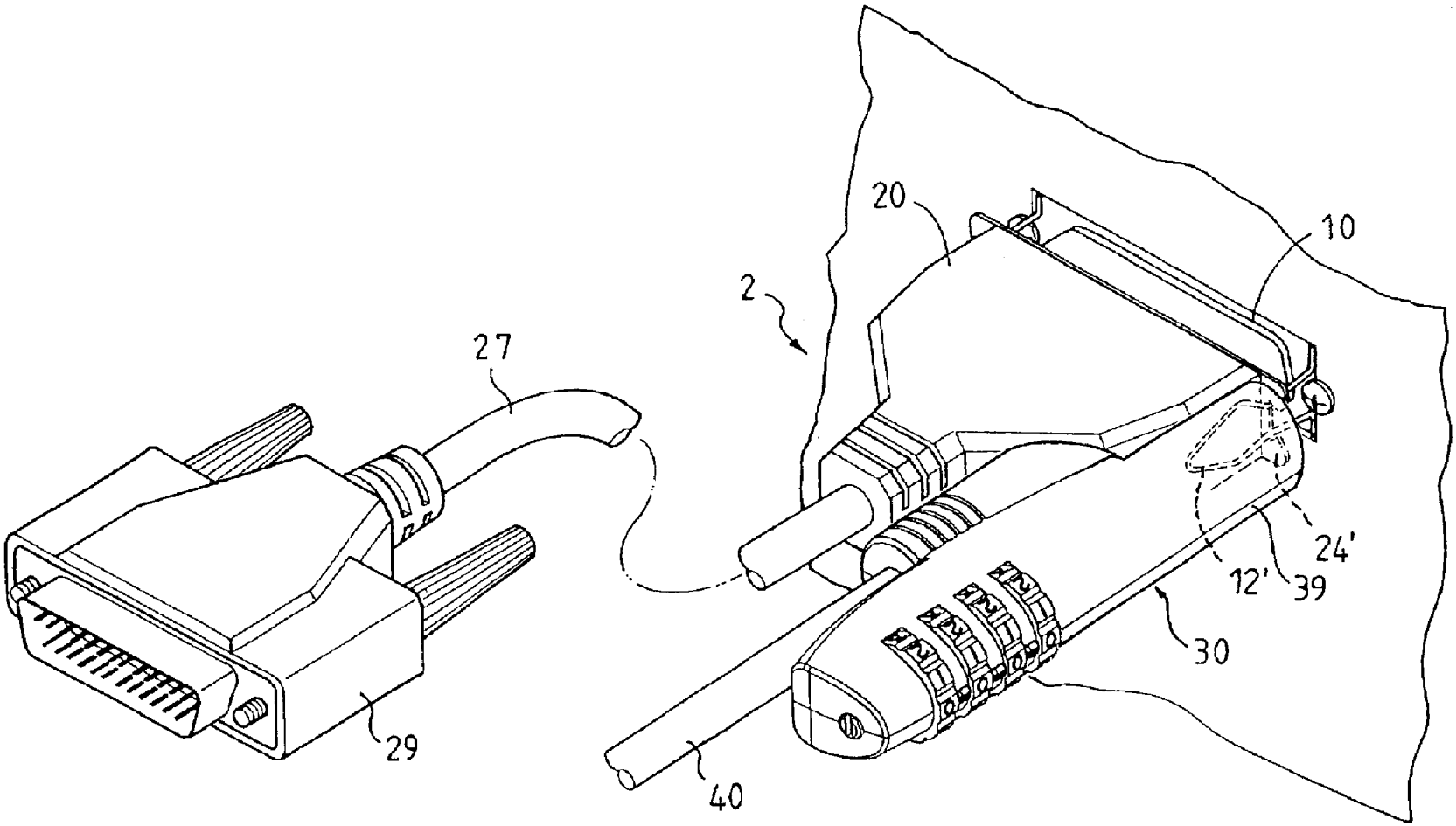
FIG. 8 illustrates the embodiment of FIG. 7 under the locked state.

FIG. 7 illustrates a parallel port that may also be adapted to the securing device of this invention. In this embodiment, the to-be-engaged means includes two resilient hoops 12' and the fasteners include slots 24' to be engaged with the resilient hoops 12', which are the standards of a parallel port connector. In use, the bypass 20 having the slots 24' are inserted into the parallel port connector. The resilient hoops 12' provided on the opposing sides of the parallel port connector are then revolved from the locations shown by phantom lines of FIG. 7 along the direction shown by the arrow A, for retaining onto the slots 24' of the bypass 20.

In this embodiment, a lock mechanism 30 similar to that shown in FIG. 3 is adopted. However, the recess 26' for mating with the latch (not shown in FIGS. 7 and 8) of the lock mechanism 30 is provided on a post 21 projecting from the bypass 20, such that when the latch of the lock mechanism 30 is under the locked state, the latch is wedged in the recess 26' to limit the vertical movement of the latch. The lock mechanism 30 is further provided with a stopper 39 that adapts to cover where the hoops 12' engage the slots 24' after the lock mechanism 30 is locked to the bypass 20 so as to prevent separation of the two.

In using the embodiment shown in FIG. 7, the bypass 20 is first connected to the connector 10. The hoops 12' are then engaged to the slots 24'. At this time, the indent 32 of the lock mechanism 30 covers the post 21 of the bypass 20 having the recess 26'. After the lock mechanism 30 comes into place, the lock mechanism 30 is switched to the locked state, such that the latch similar to that, 34, in FIG. 2 is locked in the recess 26' to prevent the latch from moving out of the recess 26', thereby locking the lock mechanism 30 to the bypass 20, when the lock mechanism 30 is locked to the bypass, because the slots 24 of the bypass 20 are covered by the stopper 39 projecting from the lock mechanism 30, the housing 31 cannot be separated from the bypass 20 unless the lock mechanism 30 is switched to the unlocked state, thereby locking the bypass 20 to the connector 10 provided on the computer 1, as shown in FIG. 9.

Figure 9:
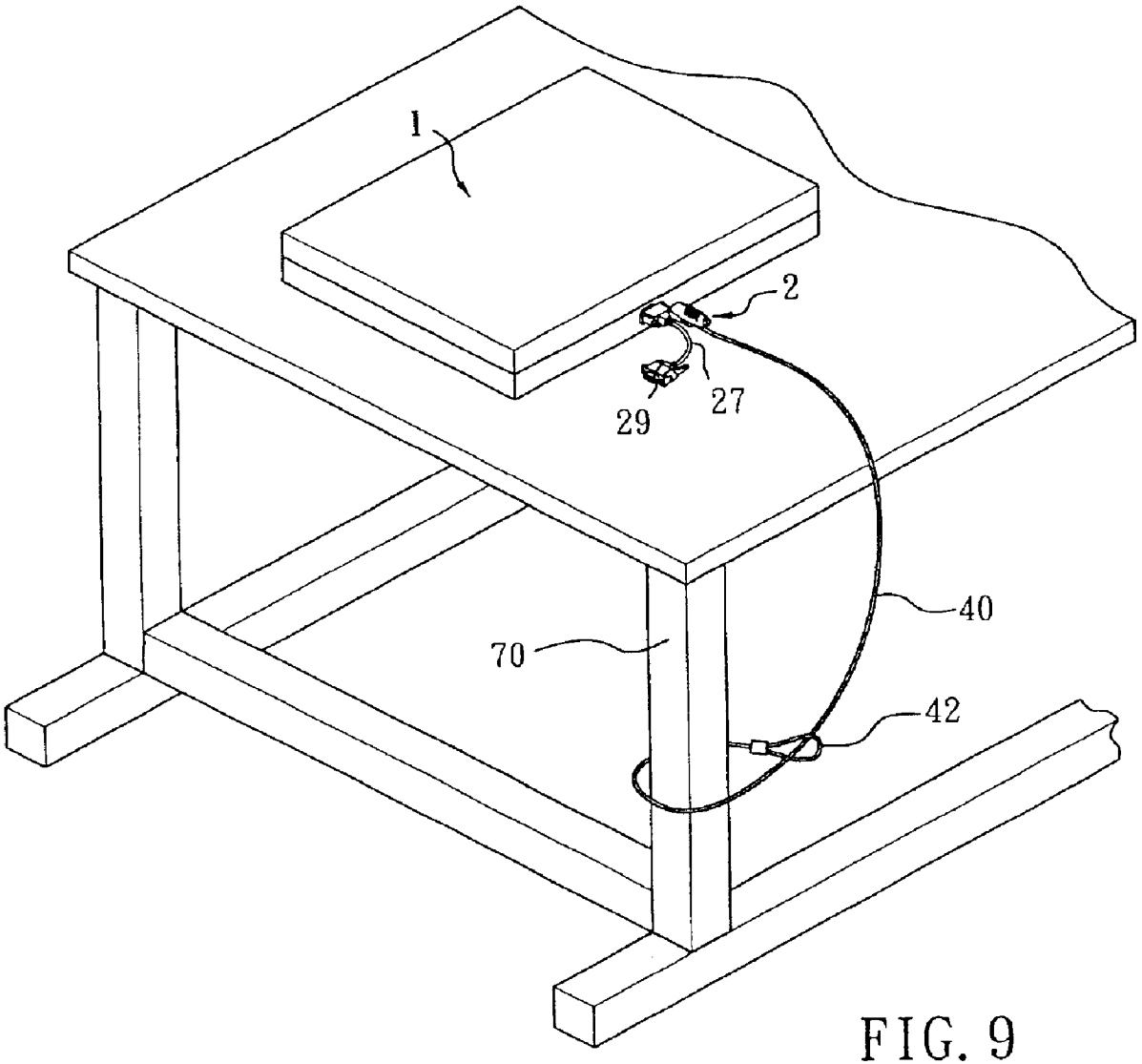
FIG. 9 illustrates the embodiment of FIG. 3 being secured to a fixture.

At this time, the user may wrap a loop 42 formed at an end of the connecting member 40 to a fixture 70, such as a leg of a table shown in FIG. 9, whereby the computer 1 is locked to the fixture 70 and cannot be removed. At the same time, the connector 10 can still be electrically accessed by way of the bypass 29 so as to retain the original function of the connector 10.

Figure 10:
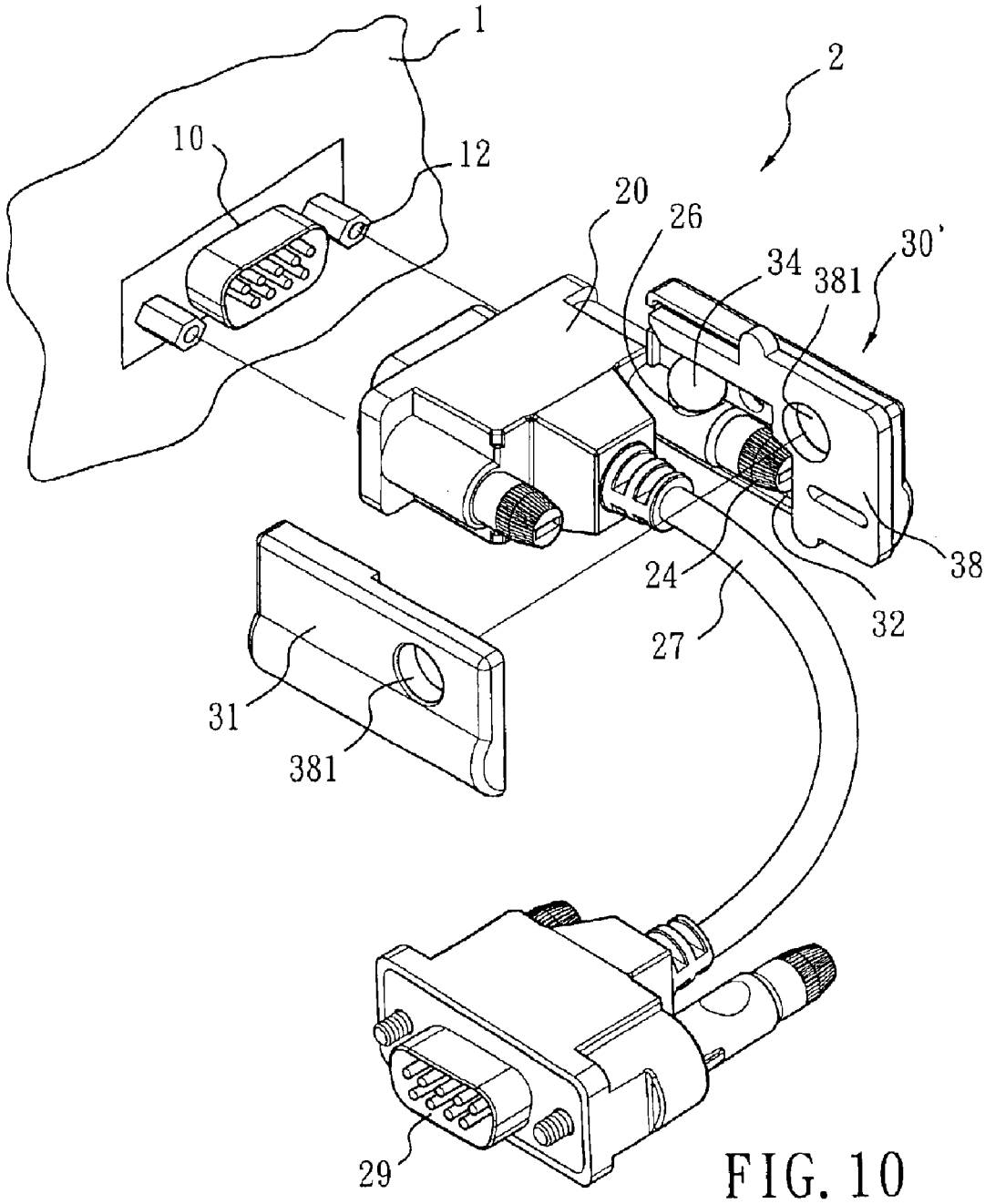
FIG. 10 is an exploded perspective view showing yet another preferred embodiment of this invention.
Figure 11:
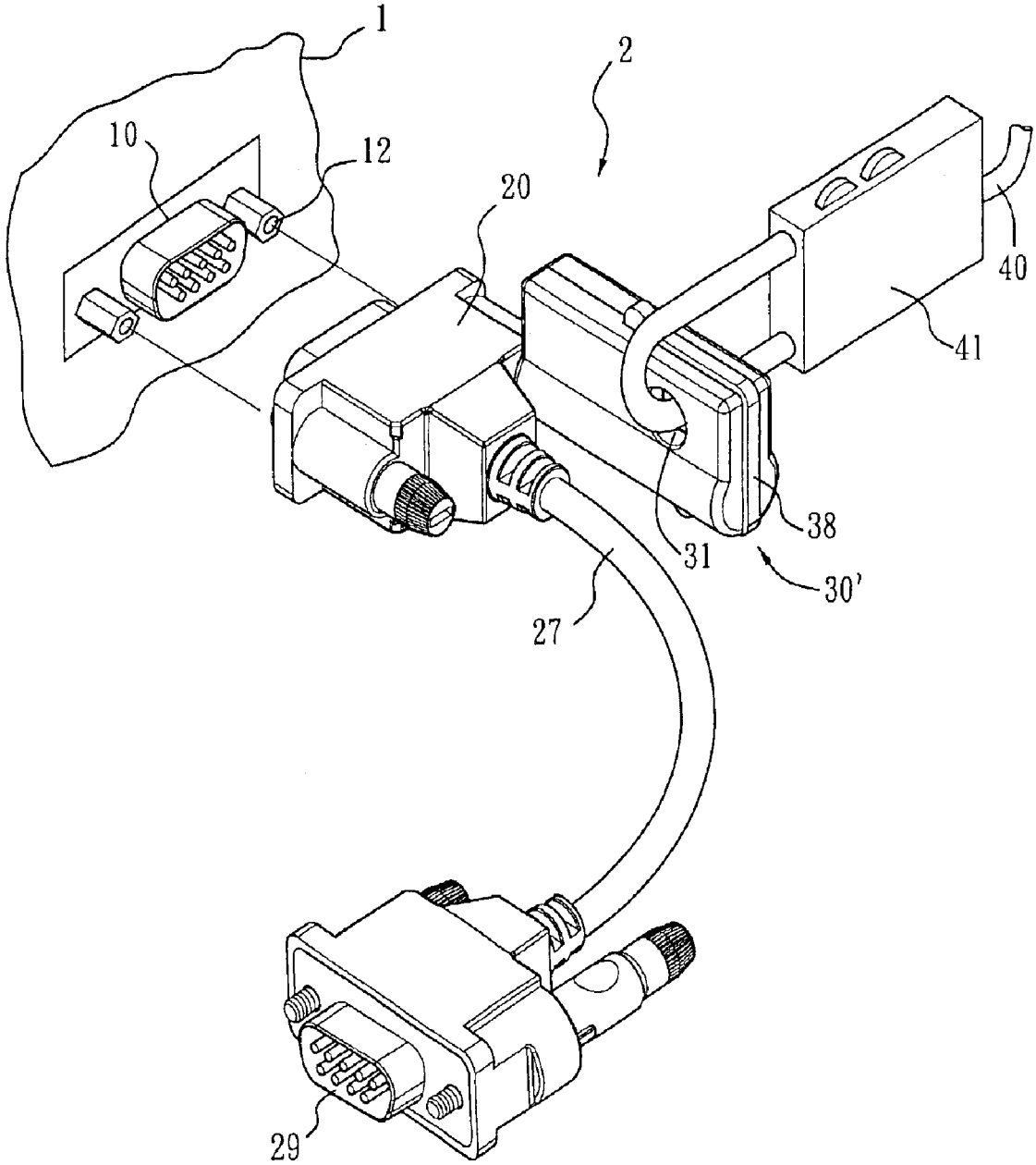
FIG. 11 is an exploded, perspective view showing the embodiment of FIG. 10 under the unlocked state.

FIGS. 10 and 11 illustrate this invention embodying another type of the lock mechanism. The differences between this embodiment and that in FIG. 2 reside in that, the lock mechanism is this embodiment includes a drawing type lock 30' and a padlock 41 having the connecting member 40. The drawing type lock 30' includes a housing 31. The housing 31 includes a controller 38 that moves in relation to the housing 31 and formed with a first locking aperture 381. An indent 32 is formed between the housing 31 and the controller 38 for receiving and covering the fastener 24. The housing 31 is further formed with a second locking aperture 301 corresponding to the first locking aperture 381.

The fastener 24 is formed with a recess 26. The lock mechanism 30 includes a latch 34 to be inserted into the recess 26. In this embodiment, the latch is a ball and the recess 26 is a semi-spherical corresponding recess.

Figure 12:
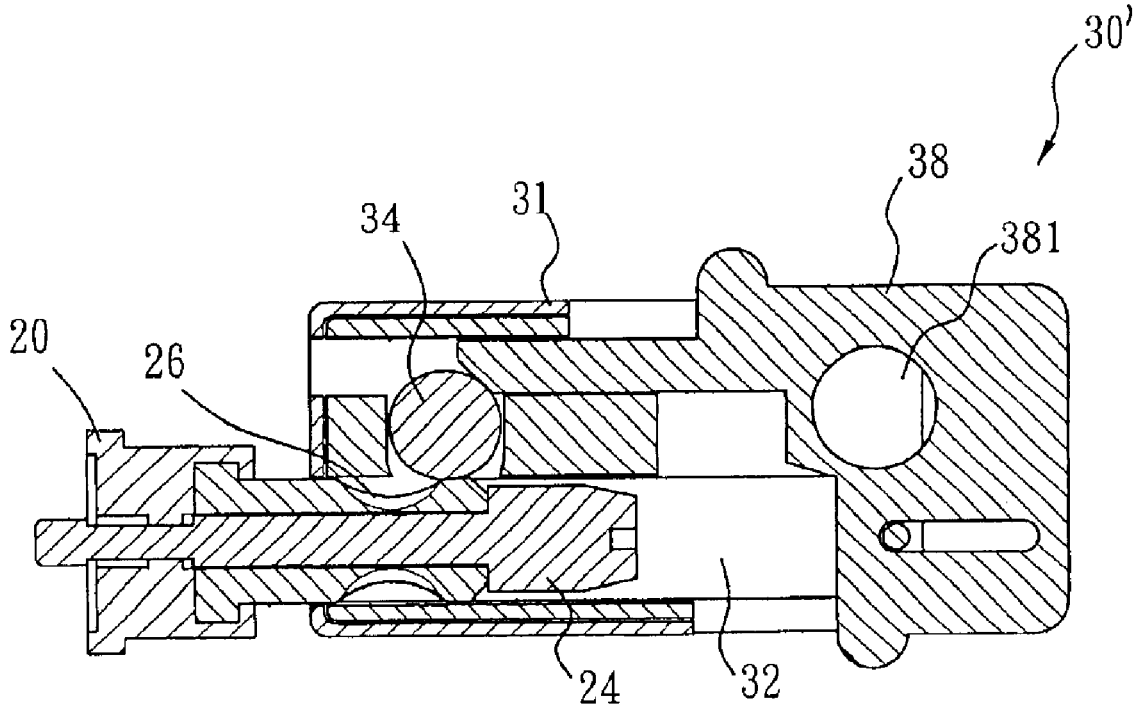
FIG. 12 is a cross-sectional view showing the embodiment of FIG. 10 in which the lock mechanism is under the unlocked state.
Figure 13:
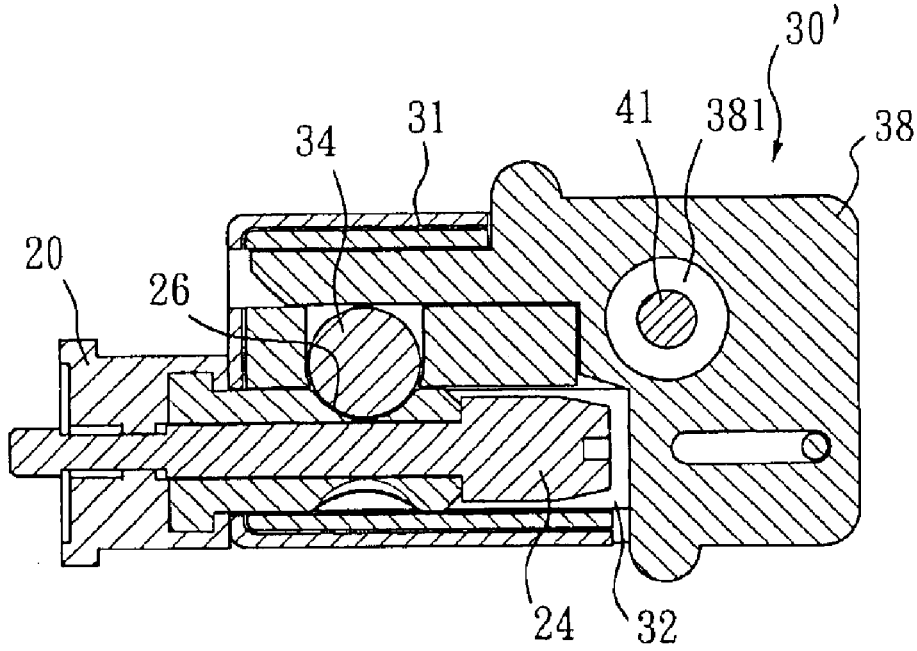
FIG. 13 is a cross-sectional view showing the embodiment of FIG. 10 in which the lock mechanism is under the locked state.

As shown in FIG. 12, when the lock mechanism 30 is under the unlocked state, the controller 38 does not urge against the latch 34 allowing vertical movement of the latch 34 in the lock mechanism 30. On the contrary, when the controller 38 is pushed, rendering the lock mechanism 30 to assume the locked state, the latch 34 is wedged in the recess 26 such that the vertical movement of the latch 34 is limited by the controller 38, as shown in FIG. 13. At this time, the padlock 41 passes through the locking apertures 301 and 381 to prevent separation of the housing 31 from the bypass 20, thereby locking the bypass 20 to the connector 1 provided on the computer 1, as shown in FIGS. 11 and 13.

The user may then wrap a loop 42 formed at an end of the connecting member 40 to a fixture 70, such as a leg of a table shown in FIG. 9, whereby the computer 1 is locked to the fixture 70 and cannot be removed. At the same time, the connector 10 can still be electrically accessed by way of the bypass 29 so as to retain the original function of the connector 10.

Figure 14:
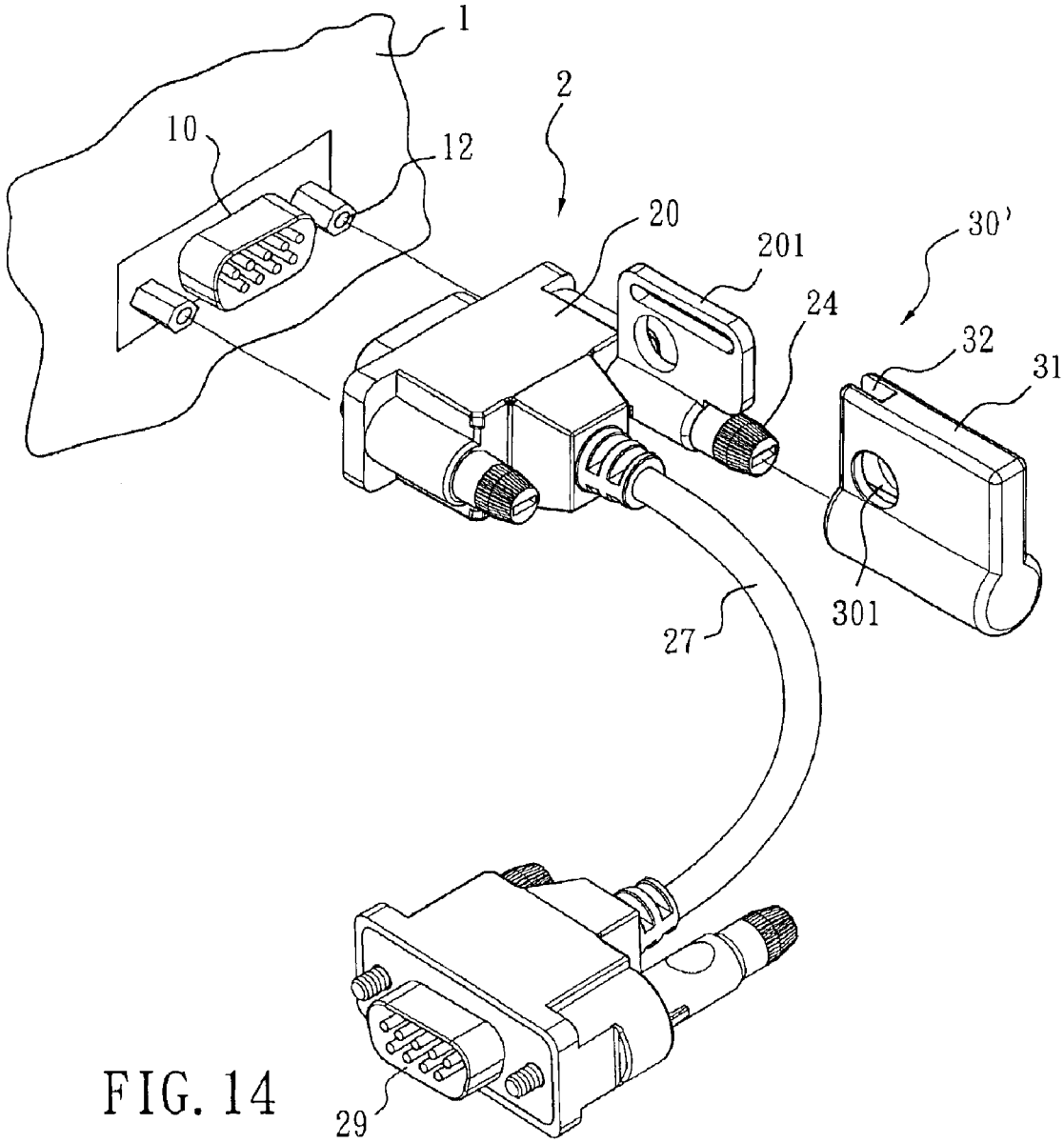
FIG. 14 is an exploded perspective view showing yet another preferred embodiment of this invention.

FIG. 14 illustrates this invention embodying another type of the drawing type lock. The differences between this embodiment and that in FIG. 2 reside in that, the lock mechanism in this embodiment includes a drawing type lock 30' and a padlock 41 having the connecting member 40. The drawing type lock 30' includes a housing 31.

Figure 15:
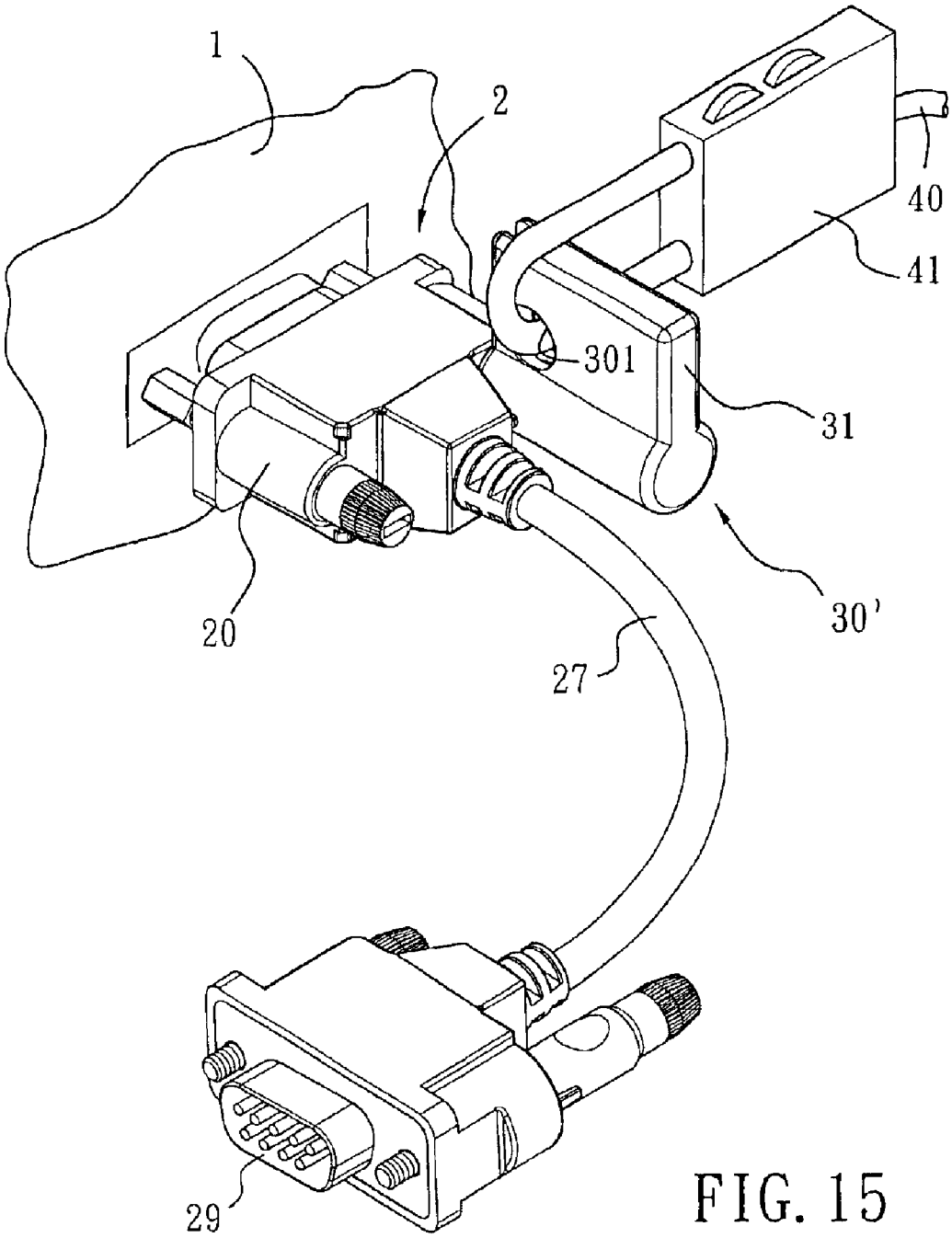
FIG. 15 is a perspective view showing the embodiment of FIG. 14 under the unlocked state.
Figure 16:
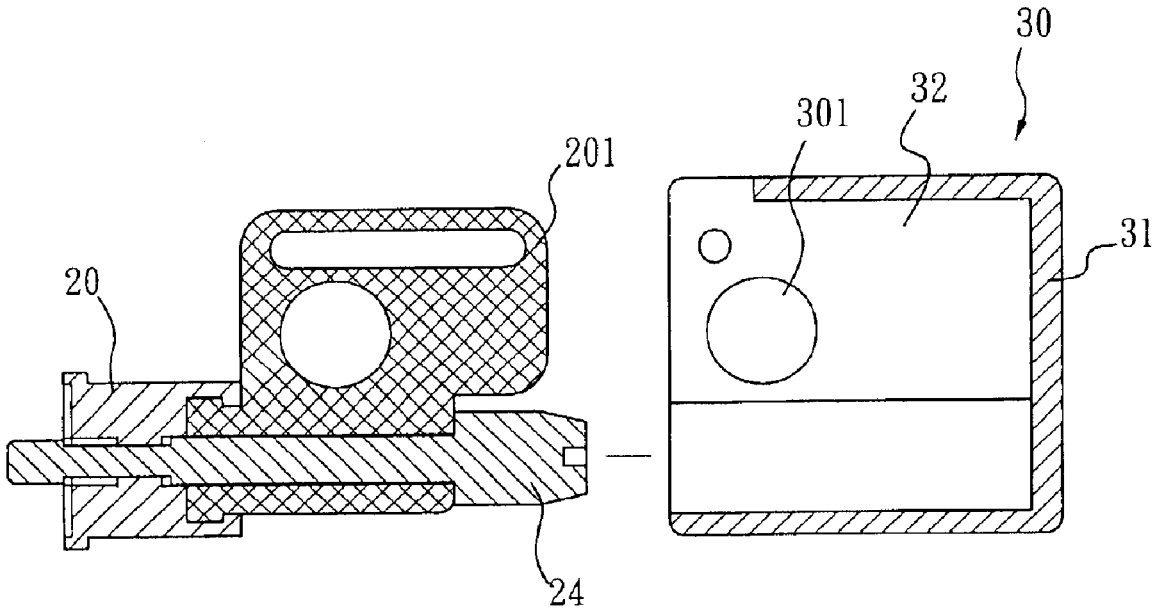
FIG. 16 is a cross-sectional view showing the embodiment of FIG. 14 in which the lock mechanism is under the unlocked state.
Figure 17:
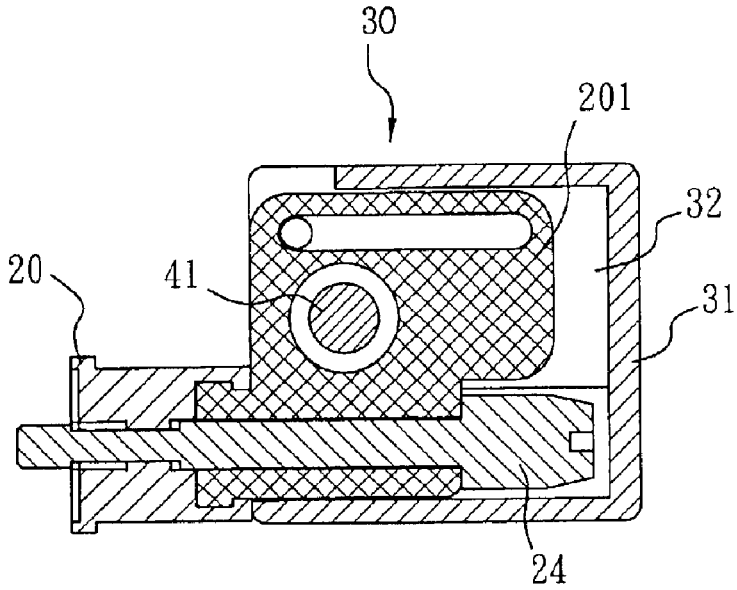
FIG. 17 is a cross-sectional view showing the embodiment of FIG. 14 in which the lock mechanism is under the locked state.

The differences between this embodiment and that in FIG. 10 reside in that, the housing 31 per se is a controller formed with a first locking aperture 301. An indent 32 is formed in the housing 31 for receiving and covering the fastener 24. The bypass 20 is extended with a flange 201 thereon. The flange 201 is formed with a second locking aperture 202 corresponding to the first locking aperture 301. The housing 31 is movable in relation to the flange 201. When the lock mechanism 30 is under the unlocked state, the housing 31 may be separated from the fastener 24 and the flange 201, as shown in FIGS. 14 and 16. On the other hand, when the housing 31, is pushed rendering the lock mechanism to assume the locked state, the housing 31 covers the fastener 24 and the flange 201, as shown in FIG. 17. At this time, the padlock 41 passes through the locking apertures 301 and 201 to prevent separation of the housing 31 from the bypass 20, thereby locking the bypass 20 to the connector 1 provided on the computer 1, as shown in FIGS. 15 and 17.

The user may then wrap a loop 42 formed at an end of the connecting member 40 to a fixture 70, such as a leg of a table shown in FIG. 9, whereby the computer 1 is locked to the fixture 70 and cannot be removed. At the same time, the connector 10 can still be electrically accessed by way of the bypass 29 so as to retain the original function of the connector 10.

Figure 18:
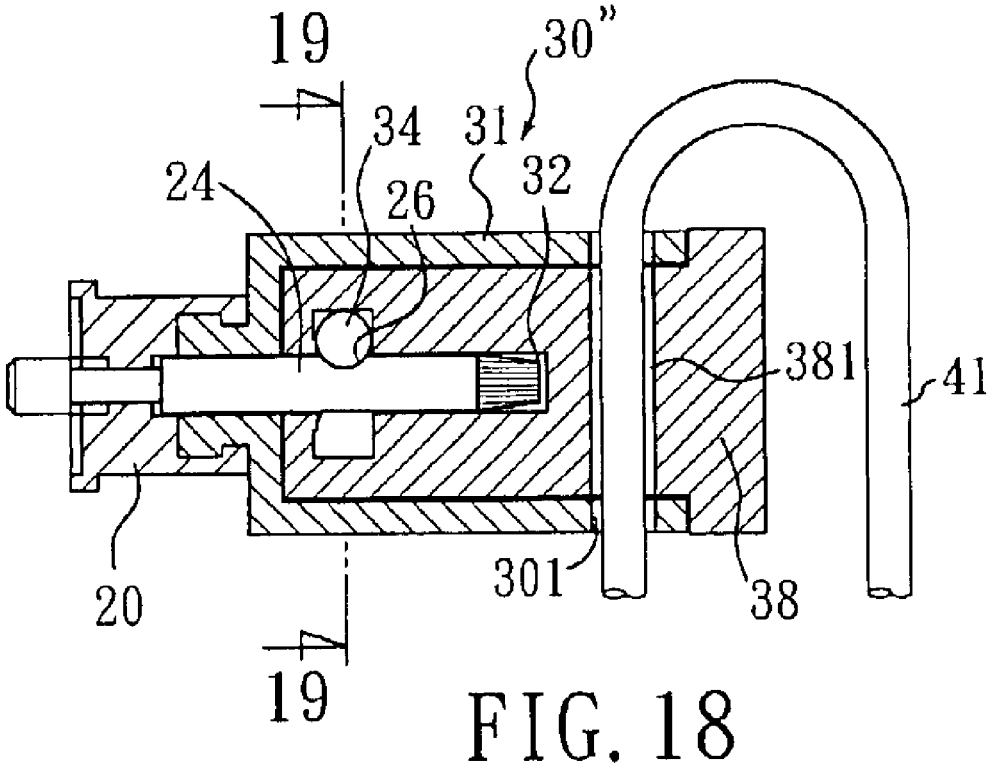
FIG. 18 is cross-sectional view showing yet another preferred embodiment of this invention in which the lock mechanism is under the locked state.

FIG. 18 illustrates this invention embodying another type of the lock mechanism. The differences between this embodiment and those in FIGS. 2, 8, 10 and 14 reside in that, the lock mechanism in this embodiment includes a rotary lock 30" and a padlock 41 having the connecting member 41 shown in FIGS. 10 and 14. The rotary lock 30" includes a housing 31. The housing 31 includes a controller 38 that rotates in relation to the housing 31 and formed with a first locking aperture 381. An indent 32 is formed between the housing 31 and the controller 38 for receiving and covering the fastener 24. The housing 31 is further formed with a second locking aperture 301 corresponding to the first locking aperture 381.

The fastener 24 is formed with a recess 26. The lock mechanism 30 includes a latch 34 to be inserted into the recess 26. In this embodiment, the latch is a ball and the recess 26 is a semi-spherical corresponding recess.

Figure 19:
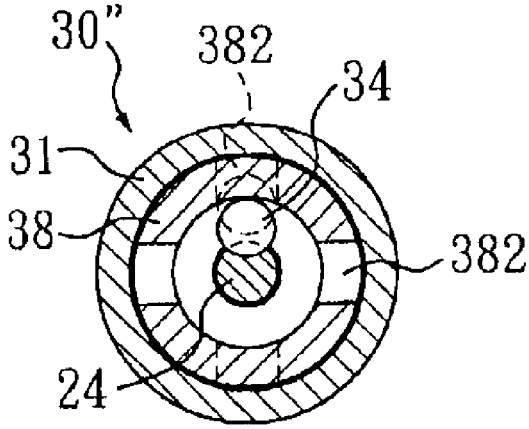
FIG. 19 is a cross-sectional view taken along lines 19—19 of FIG. 18.

As shown by the phantom lines in FIG. 19, when the lock mechanism 30 is under the unlocked state, the latch 34 adapts to fall into a hole 382 in the controller 38 such that the controller 38 does not urge against the latch 34 allowing vertical movement of the latch 34 in the lock mechanism 30. On the contrary, when the controller 38 is rotated 90 degrees, causing the latch 34 to leave the hole 382, the latch 34 is wedged in the recess 26 such that the vertical movement of the latch 34 is limited by the controller 38, as shown in FIGS. 18 and 19. At this time, the padlock 41 passes through the locking apertures 301 and 381 to prevent separation of the housing 31 from the bypass 20, thereby locking the bypass 20 to the connector 1 provided on the computer 1, as shown in FIGS. 11 and 13.

This invention is related to a novel creation that makes a breakthrough in the art. Aforementioned explanations, however, are directed to the description of preferred embodiments according to this invention. Various changes and implementations can be made by persons skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

What is claimed is:

1. A securing device for an electronic device, the securing device being connected to a connector provided on the electronic device having at least one to-be-engaged means at an outer side of the electronic device, the securing device comprising:

a bypass having at least one fastener and a recess provided at the bypass, wherein the bypass is to be electrically connected to the connector and has a bypass interface, and the at least one fastener engages the corresponding to-be-engaged means through the bypass, thereby preventing separation of the bypass from the connector when the bypass is connected to the connector;

a lock mechanism having a housing and a latch, wherein the lock mechanism is detachably locked to the bypass when one of the at least one fastener is covered by the housing and the latch is adapted to wedge into the recess, thereby the bypass is secured to the connector and the lock mechanism prevents separation of the fastener from the to-be-engaged means; and a connecting member, for securing the combined lock mechanism and bypass to a fixture.

2. The securing device according to claim 1, wherein the to-be-engaged means includes a screw hole and the at least one fastener includes a bolt to be threaded to the screw hole.

3. The securing device according to claim 2, wherein the housing includes an indent formed therein to cover the bolt.

4. The securing device according to claim 1, wherein the recess is formed at the fastener.

5. The securing device according to claim 1, wherein the to-be-engaged means further comprises a hoop, and the fastener further comprises a slot to be engaged with the hoop.

6. The securing device according to claim 5, wherein the lock mechanism further comprises a housing and a stopper projecting from the housing such that the stopper prevents separation of the hoop from the slot when the lock mechanism is locked to the bypass and one of the at least one fastener is covered by the housing and the latch is adapted to wedge into the recess.

7. The securing device according to claim 6, wherein the recess is formed on a post projecting from the bypass.

8. The securing device according to claim 1, wherein the lock mechanism is a combination lock.

9. The securing device according to claim 1, wherein the lock mechanism is a key lock.

10. The securing device according to claim 1, wherein the bypass and the connector have compatible transmission interface specifications.

11. The securing device according to claim 1, wherein the bypass includes a mating connector of the connector.

12. The securing device according to claim 1, wherein the connecting member having an end connected to the fixture and another connected to the bypass.

13. The securing device according to claim 12, wherein the end of the connecting member connected to the fixture is formed with a loop for securing the electronic device having the connector to the fixture.

14. The securing device according to claim 1, wherein the connecting member is a cable.

15. A securing device for an electronic device, the securing device being connected to a connector provided on the electronic device having at least one to-be-engaged means at an outer side of the electronic device, the securing device comprising:

a bypass having at least one fastener and a recess provided at the fastener, wherein the bypass is to be electrically connected to the connector and has a bypass interface, and the at least one fastener engages the corresponding to-be-engaged means through the bypass, thereby preventing separation of the bypass from the connector when the bypass is connected to the connector;

a lock mechanism having a housing and a controller covered by the housing and moveable in relation to the housing, the controller having a latch and formed with a first locking aperture corresponding to a second locking aperture formed in the housing, wherein the lock mechanism is detachably locked to the bypass when one of the at least one fastener is covered by the housing, the latch is adapted to wedge into the recess and the first and the second locking apertures allow a padlock to pass through, thereby the bypass is secured to the connector and the lock mechanism prevents separation of the fastener from the to-be-engaged means; and a connecting member, for securing the combined lock mechanism and bypass to a fixture.

16. The securing device according to claim 15, wherein the to-be-engaged means includes a screw hole and the at least one fastener includes a bolt to be threaded to the screw hole.

17. The securing device according to claim 16, wherein the housing includes an indent formed therein to cover the bolt.

18. The securing device according to claim 15, wherein the bypass and the connector have compatible transmission interface specifications.

19. The securing device according to claim 15, wherein the bypass includes a mating connector of the connector.

20. The securing device according to claim 15, wherein the connecting member having an end connected to the fixture and another connected to the bypass.

21. The securing device according to claim 20, wherein the end of the connecting member connected to the fixture is formed with a loop for securing the electronic device having the connector to the fixture.

22. The securing device according to claim 15, wherein the connecting member is a cable.

23. A securing device for an electronic device, the securing device being connected to a connector provided on the electronic device having at least one to-be-engaged means at an outer side of the electronic device, the securing device comprising:

a bypass having at least one fastener and a flange extending from the bypass having a second locking aperture, wherein the bypass is to be electrically connected to the connector and has a bypass interface, and the at least one fastener engages the corresponding to-be-engaged means through the bypass, thereby preventing separation of the bypass from the connector when the bypass is connected to the connector;

a lock mechanism having a housing formed with a first locking aperture corresponding to the second locking aperture, wherein the lock mechanism is detachably locked to the bypass when one of the at least one fastener and the flange are covered by the housing and the first and the second locking apertures allow a padlock to pass through, thereby the bypass is secured to the connector and the lock mechanism prevents separation of the housing from the flange and separation of the fastener from the to-be-engaged means; and a connecting member, for securing the combined lock mechanism and bypass to a fixture.

24. The securing device according to claim 23, wherein the to-be-engaged means includes a screw hole and the at least one fastener includes a bolt to be threaded to the screw hole.

25. The securing device according to claim 24, wherein the housing includes an indent formed therein to cover the bolt and the flange.

26. The securing device according to claim 23, wherein the lock mechanism includes a drawing type lock and the padlock is to be locked to the drawing type lock.

27. The securing device according to claim 23, wherein the lock mechanism includes a rotary lock and the padlock is to be locked to the rotary lock.

28. The securing device according to claim 23, wherein the bypass and the connector have compatible transmission interface specifications.

29. The securing device according to claim 23, wherein the bypass includes a mating connector of the connector.

30. The securing device according to claim 23, wherein the connecting member having an end connected to the fixture and another connected to the bypass.

31. The securing device according to claim 30, wherein the end of the connecting member connected to the fixture is formed with a loop for securing the electronic device having the connector to the fixture.

* * * * *